US008172344B2

(12) United States Patent
Eyer et al.

(10) Patent No.: US 8,172,344 B2
(45) Date of Patent: May 8, 2012

(54) SAFETY CABINET WITH SPILL-SLOPED SHELF

(75) Inventors: Steven Michael Eyer, Charleston, IL (US); Patrick A. Malone, Chicago, IL (US)

(73) Assignee: Justrite Manufacturing Company L.L.C., Des Plaines, IL (US)

( * ) Notice: Subject to any disclaimer, the term of this patent is extended or adjusted under 35 U.S.C. 154(b) by 161 days.

(21) Appl. No.: 11/869,481

(22) Filed: Oct. 9, 2007

(65) Prior Publication Data

US 2009/0091220 A1 Apr. 9, 2009

(51) Int. Cl.
*B01L 9/02* (2006.01)

(52) U.S. Cl. ... 312/209; 312/351; 108/107; 108/147.16; 211/187

(58) Field of Classification Search ..... 108/193, 108/106, 107, 109, 110, 147.16; 312/351, 312/408, 209; 211/187, 103, 190, 207, 59.2
See application file for complete search history.

(56) References Cited

U.S. PATENT DOCUMENTS

| | | | | |
|---|---|---|---|---|
| 177,207 | A | | 5/1876 | Chandler |
| 188,512 | A | | 3/1877 | Harlow |
| 1,019,934 | A | | 3/1912 | Walker |
| 1,973,854 | A | | 9/1934 | Hoffman et al. |
| 2,635,027 | A | * | 4/1953 | Rasmussen ..... 312/229 |
| 3,044,631 | A | * | 7/1962 | Greenman et al. ..... 108/1 |
| 3,168,365 | A | * | 2/1965 | Evans ..... 312/351 |
| 3,269,788 | A | | 8/1966 | Kneer |
| 4,073,384 | A | | 2/1978 | Celeste |
| 4,418,969 | A | * | 12/1983 | Hettman ..... 312/249.9 |
| 4,456,316 | A | | 6/1984 | Lundgren |
| 4,775,057 | A | * | 10/1988 | Zingeser ..... 211/133.1 |
| 5,127,340 | A | * | 7/1992 | Maro et al. ..... 108/107 |
| 5,377,622 | A | | 1/1995 | Lauttenbach et al. |
| 5,992,098 | A | * | 11/1999 | Flider et al. ..... 49/367 |
| 6,729,701 | B2 | * | 5/2004 | Carter et al. ..... 312/222 |
| 6,871,747 | B2 | * | 3/2005 | Bustos ..... 211/50 |
| 7,001,001 | B1 | * | 2/2006 | Spencer ..... 312/219 |
| 2004/0066122 | A1 | * | 4/2004 | Holmes ..... 312/311 |
| 2005/0224428 | A1 | | 10/2005 | Weber |
| 2006/0059934 | A1 | * | 3/2006 | Howington et al. ..... 62/256 |
| 2008/0106174 | A1 | * | 5/2008 | Marcus et al. ..... 312/215 |

* cited by examiner

*Primary Examiner* — Janet M Wilkens
*Assistant Examiner* — Daniel Rohrhoff
(74) *Attorney, Agent, or Firm* — Leydig, Voit & Mayer, Ltd.

(57) ABSTRACT

A safety cabinet includes an enclosure defining an opening and a door rotatably attached to the enclosure. The door is movable between an open position and a closed position, the door configured to selectively cover the enclosure when in the closed position. The safety cabinet comprises a spill-sloped shelf for directing fluid into a sump area of the cabinet and preventing damage to objects in the safety cabinet or harm to users of the safety cabinet.

13 Claims, 14 Drawing Sheets

SAFETY CABINET WITH SPILL-SLOPED SHELF

FIELD OF THE INVENTION

The present invention pertains generally to a safety cabinet, and more particularly, to a safety cabinet with a spill-containing mechanism for collecting fluid that may leak from containers stored in the safety cabinet to prevent such leaked fluid from further leaking from the safety cabinet.

BACKGROUND OF THE INVENTION

A safety cabinet for storing containers of flammable, explosive, or otherwise dangerous liquids is known in the art. Such a safety cabinet located at a plant allows for onsite storage of the containers. The safety cabinet can be provided to insulate the containers stored within it from the direct effects of an external fire to prevent the liquid inside the containers from adding to the deleterious effect of the original fire.

Occasionally, inadvertent spills may occur within the safety cabinet or the containers may leak, thereby exposing other items stored in the safety cabinet to the potentially harmful liquids. Furthermore, a user may be exposed to the spilled or leaked liquids when accessing the safety cabinet. Accordingly, it would be desirable to provide a safety cabinet that helps prevent the harmful effects that may result from a liquid spill or leak.

SUMMARY OF THE INVENTION

This disclosure describes, in one aspect, a safety cabinet comprising an enclosure that defines an interior cavity with an opening for allowing access to the interior. The enclosure can include a base, right and left sidewalls, a back wall, and a top. The safety cabinet can include a door rotatably attached to the enclosure, where the door is movable between an open position and a closed position. The door is configured to selectively cover at least a portion of the opening of the enclosure when in the closed position. First and second pair of shelf mounts can be provided which are mounted to the interior cavity of the enclosure. The shelf mounts can be in spaced relationship with respect to each other. A shelf can be disposed in the cavity of the enclosure. The shelf can be supported by the first and second pairs of shelf mounts. The shelf can include a support surface, first and second ends, and first and second edges. The support surface can extend longitudinally between the first and second ends. The first and second edges of the shelf can be in spaced relationship to each other and laterally define the support surface. The first and second edges can extend between the first and second ends. Each end of the shelf can have a first mounting surface and a second mounting surface. The first mounting surface can be closer to the first edge than to the second edge. The second mounting surface can be closer to the second edge than the first edge. The first mounting surface can be a first distance away from the support surface. The second mounting surface can be a second distance away from the support surface with the first distance being greater than the second distance. The shelf can be supported by the first and second pairs of shelf mounts such that the second edge of the shelf is adjacent the back wall of the enclosure. The shelf mounts can respectively support the mounting surfaces of the first and second ends of the shelf such that the support surface of the shelf is inclined with the first edge of the shelf being higher than the second edge.

In another aspect of the disclosure, a safety cabinet can be provided that includes an enclosure defining an interior cavity and an opening for accessing the interior cavity. The enclosure can include a base, right and left sidewalls, a back wall, and a top. One or more doors can be rotatably attached to the enclosure. The doors can be movable between an opened position and a closed position such that the doors selectively cover at least a portion of the opening of the enclosure when in the closed position. A plurality of shelf mounts can be mounted to the interior cavity of the enclosure. A shelf can be provided within the cavity of the enclosure. The shelf can include a plurality of mounting surfaces. The mounting surfaces of the shelf can be supported by a corresponding plurality of shelf mounts. At least one of the shelf mounts and the mounting surfaces can be configured such that the shelf is inclined.

In yet another aspect of the disclosure, a spill-sloped shelf for a safety cabinet can be provided. The spill-sloped shelf can include a support surface having a perimeter. A flange can depend from the perimeter of the support surface. A first pair and a second pair of mounting surfaces can be disposed in the flange. The first mounting surfaces can each be disposed a first distance away from the perimeter of the support surface. The second mounting surfaces can be In another aspect, a safety cabinet is provided comprising an enclosure defining an opening, where the enclosure has a base, right and left sidewalls, a back wall, and a top. The safety cabinet includes one or more doors rotatably attached to the enclosure with each being movable between an open position and a closed position. Each door is configured to selectively cover at least a portion of the opening of the enclosure when in the closed position. A spill-sloped shelf is arranged in the enclosure, and the spill-sloped shelf has first and second ends. The ends can both have first and second deep notches and first and second shallow notches. The notches of each end can be configured such that each end can be mounted to either of the right and left sidewalls.

In one arrangement, the notches are arranged at each end such that the deep notches are disposed in between the shallow notches. The deep notches that are disposed closest to the back wall can be connected to either the right and left sidewalls, and the shallow notches that are disposed further from the back wall can be connected to the right or left sidewalls. The shelf can be turned end-for-end and installed in the safety cabinet such that, again, the deep notches that are disposed closest to the back wall are connected to the right and left sidewalls and the shallow notches that are disposed further from the back are connected to the right and left sidewalls. In either arrangement, the shelf can be mounted such that its back edge is disposed below its front edge such that the shelf is inclined toward the back wall of the enclosure.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF EMBODIMENTS OF THE INVENTION

In the following description, reference is sometimes made to the "left," "right" "top," "bottom," or other regions of the safety cabinet and its various components. It should be understood that these terms are used solely for convenient reference and are not intended to limit the invention in any way.

Figure 1:
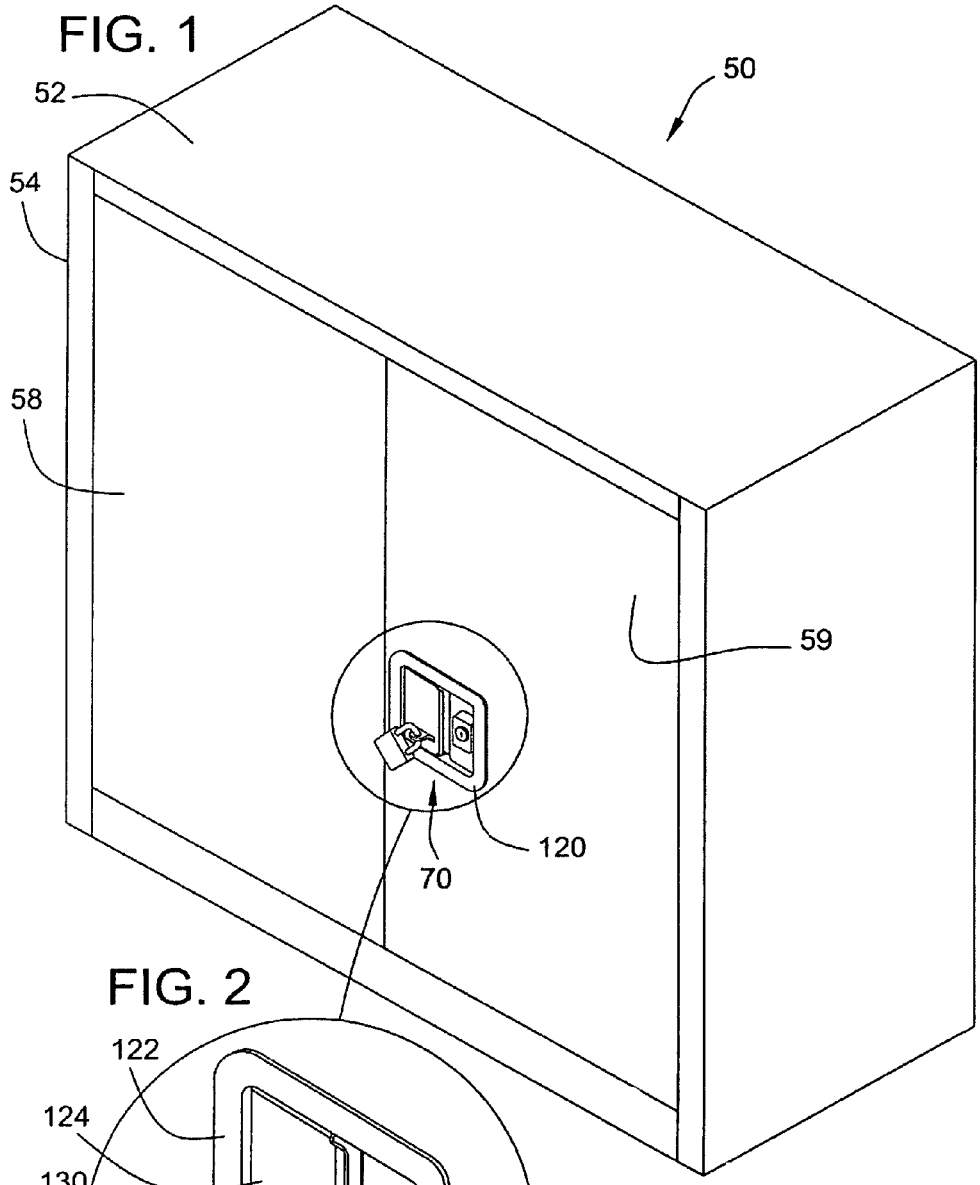
FIG. 1 is a perspective view of an embodiment of a safety cabinet.

Turning now to the drawings, there is shown in FIG. 1 an illustrative fireproof safety cabinet 50 according to an embodiment of the present invention. The safety cabinet 50 can be similar in construction to a safety cabinet shown and described in U.S. Pat. No. 6,729,701 to Carter et al., which is incorporated by reference herein as though it were set forth in its entirety. Systems and components of a safety cabinet not described in detail herein can be identical to the corresponding systems and components described in U.S. Pat. No. 6,729,701.

Figure 4:
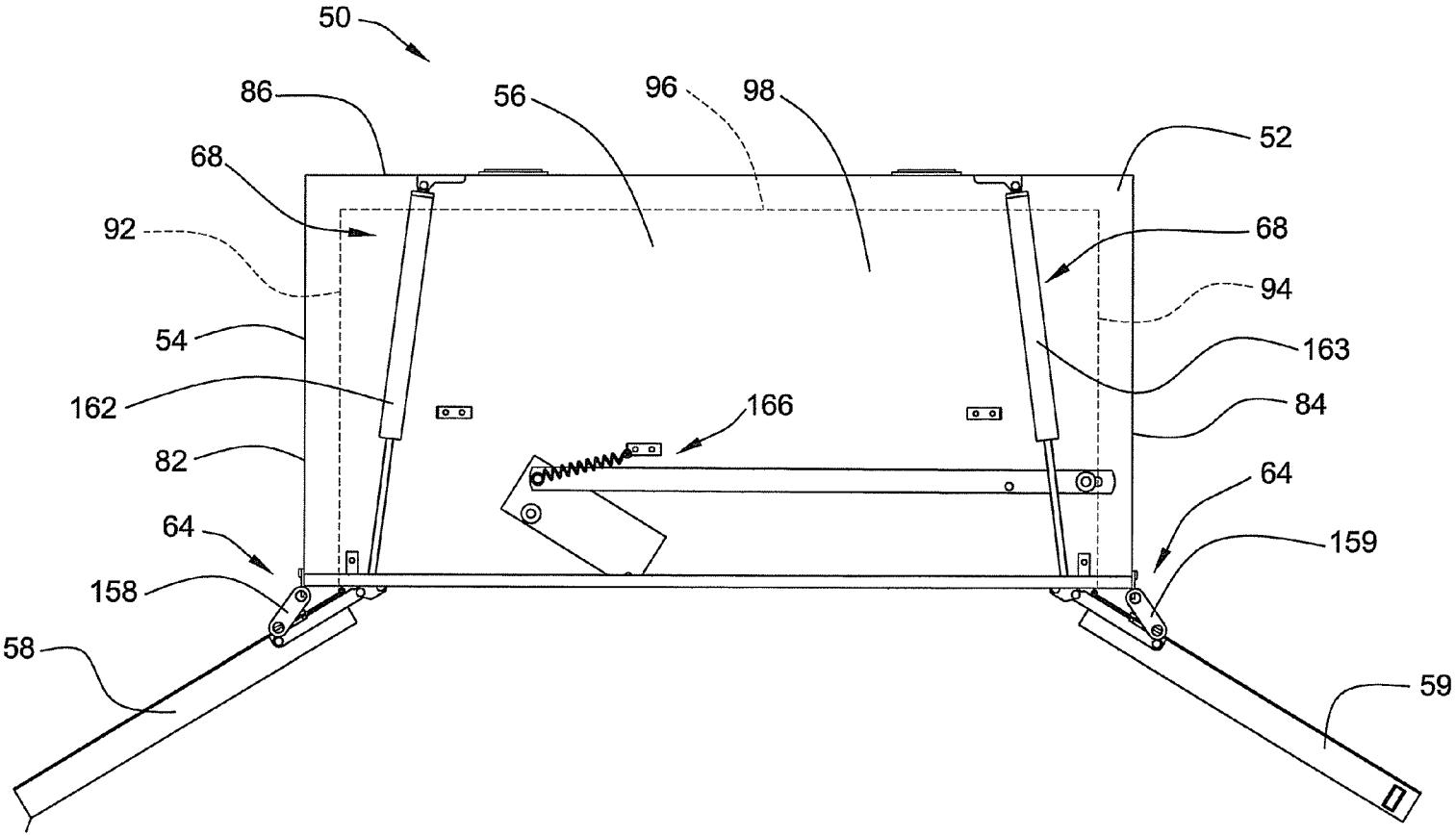
FIG. 4 is a top plan view of the safety cabinet of FIG. 1 with a top removed for illustrative purposes.
Figure 5:
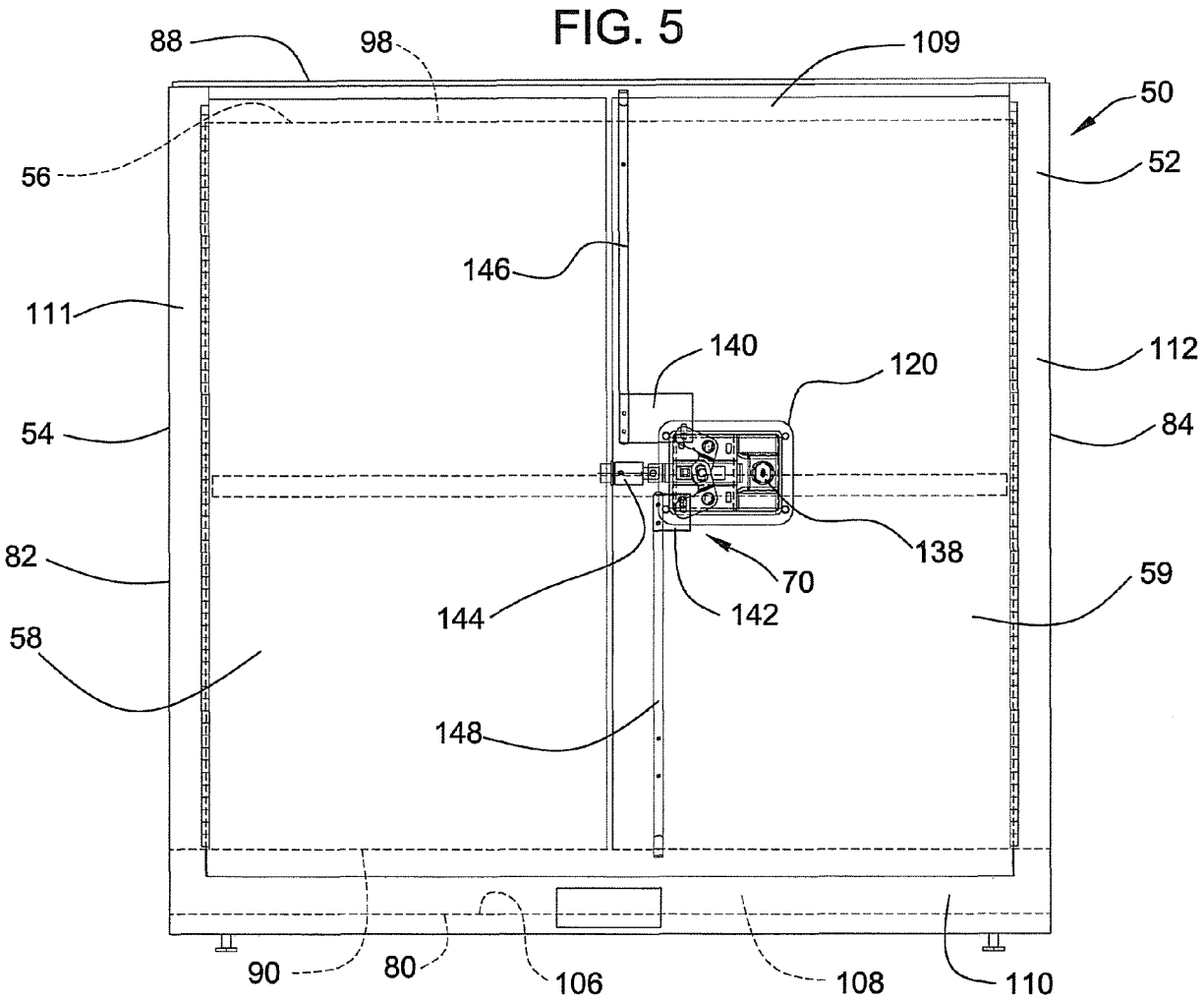
FIG. 5 is a front elevational view of the safety cabinet of FIG. 1 with some internal components shown for illustrative purposes.

Referring to FIG. 1, the safety cabinet 50 can include an enclosure 52 having an outer shell 54 and an inner shell 56 (FIG. 5), a left door 58, and a right door 59. Referring to FIG. 4, the safety cabinet 50 can include a retaining system 64 for retaining the doors 58, 59 in an open position and a closure system 68 for automatically closing the doors 58, 59. Referring to FIG. 5, the safety cabinet 50 can include a latch system 70 for latching the doors 58, 59 in a closed position to cover the enclosure 52. The safety cabinet 50 can be used to store, for example, flammable liquids, flammable waste, corrosives, pesticides, or combustible waste.

Referring to FIG. 5, the outer shell 54 includes an outer bottom wall 80 (see FIG. 6 also), an outer left side wall 82, an outer right side wall 84, an outer rear wall 86 (FIG. 4), and an outer top wall 88. The enclosure 52 includes the inner shell 56 to provide a double-walled construction, wherein each of the outer walls of the outer shell 54 has a corresponding inner wall of the inner shell 56, with the corresponding inner and outer walls separated by a predetermined distance to define an insulative air space.

Referring to FIG. 4, the outer left and right side walls 82, 84 have corresponding inner left and right side walls 92, 94, respectively. The outer rear wall 86 has a corresponding inner rear wall 96. The outer top wall 88 has a corresponding inner top wall 98 (see FIG. 5 also).

Referring to FIG. 5, the outer bottom wall 80 has a corresponding inner bottom wall 90. A liner surface 106 is disposed between the inner bottom surface 90 and the outer bottom surface 80 of the enclosure 52. The liner surface 106 is in spaced relation to the inner bottom surface 90 to define a sump area 108. The liner surface 106 provides a sealed surface that is liquid tight. The sump area 108 is provided to collect liquid that is spilled inside the enclosure 52 or leaks from a vessel stored in the cabinet 50, for example. The outer bottom wall 80 and the inner bottom wall 90 define the base of the enclosure.

Figures 6, 7:
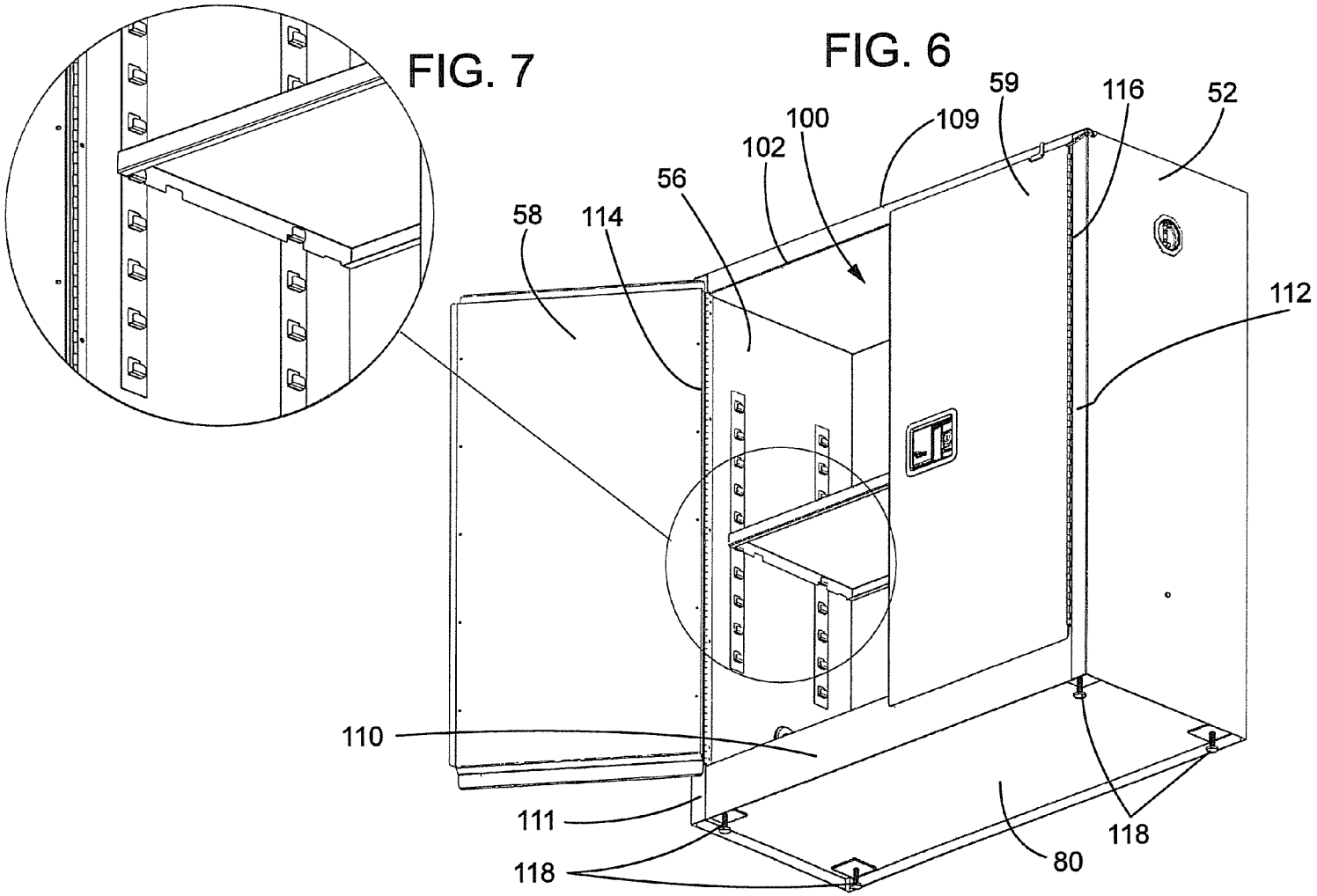
FIG. 6 is a perspective view of the safety cabinet of FIG. 1 with a left door in an open position and a right door in a closed position.
FIG. 7 is an enlarged detail view taken from FIG. 6 showing a first end of a spill-sloped shelf mounted to an inner left sidewall of the enclosure of the safety cabinet.

Referring to FIG. 5, the enclosure 52 includes a top jamb 109, a bottom jamb 110, a left jamb 111, and a right jamb 112. Referring to FIG. 6, the inner shell 56 defines a cavity 100 that is accessible through an opening 102. The jambs 109, 110, 111, 112 bound the opening 102. It will be understood that the size of the enclosure 52 can be varied.

Figure 17:
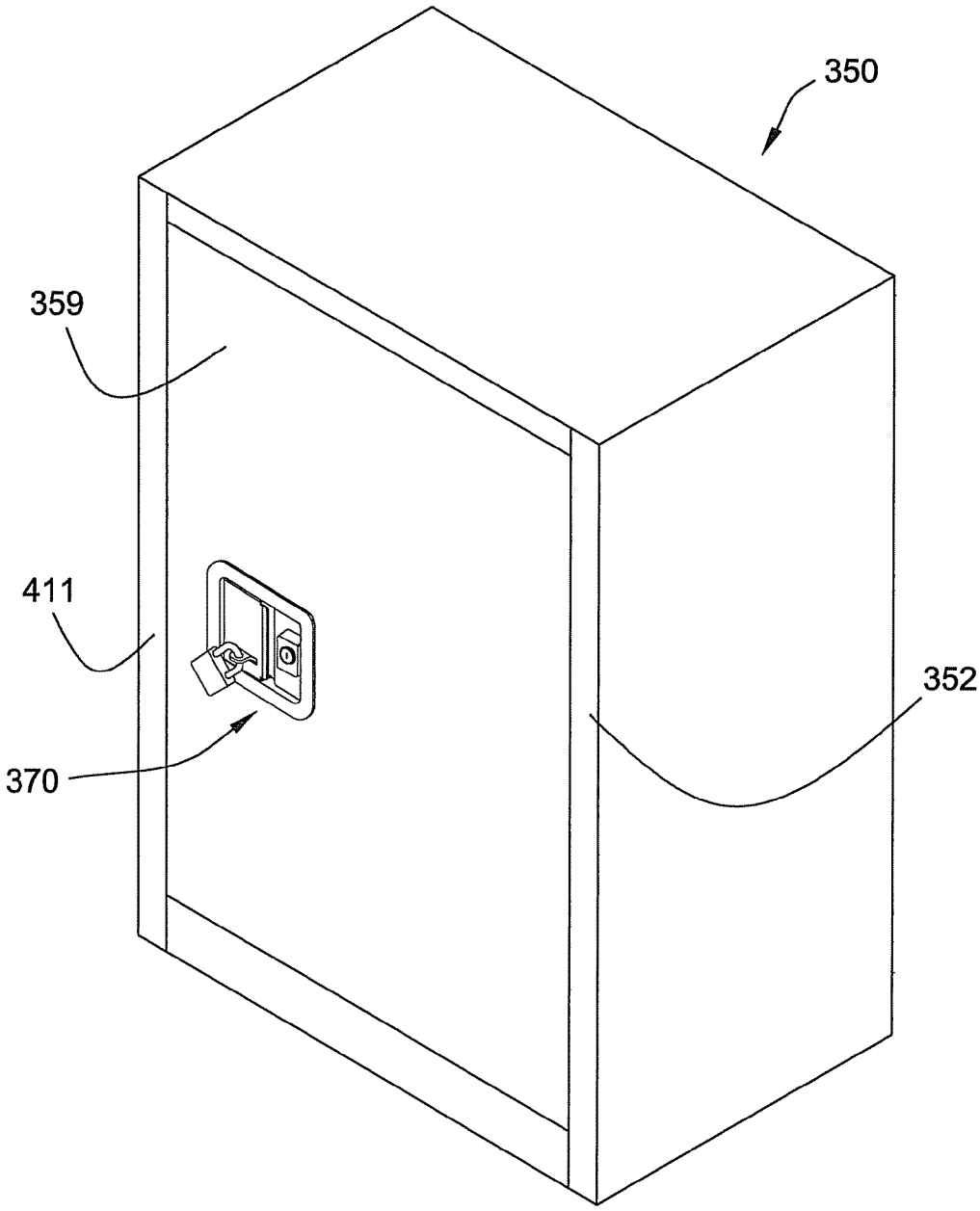
FIG. 17 is a perspective view of another embodiment of a safety cabinet according to the present invention.

Referring to FIG. 6, the left and right doors 58, 59 selectively cover the opening 102 of the enclosure 52. The left door 58 and the right door 59 are preferably rotatably mounted to the enclosure 52 by a respective left and right hinge 114, 116. The left and right doors 58, 59 can each move between a closed position and an open position. The left hinge 114 is mounted to the left jamb 111 of the enclosure 52 and the left door 58. The right hinge 116 is mounted to the right jamb 112 of the enclosure and the right door 59. The left and right hinges 114, 116 both extend substantially the full height of the left and right doors 58, 59, respectively. The left and right doors 58, 59 each have a double wall construction similar to the enclosure 52. The enclosure 52 can include a plurality of leveling legs 118 to selectively adjust the orientation of the enclosure 52 with respect to a surface upon which the safety cabinet 50 is placed. It will be understood that in other embodiments, the safety cabinet can include a single door to selectively cover the opening of the enclosure, as shown in FIG. 17, for example.

Figure 2:
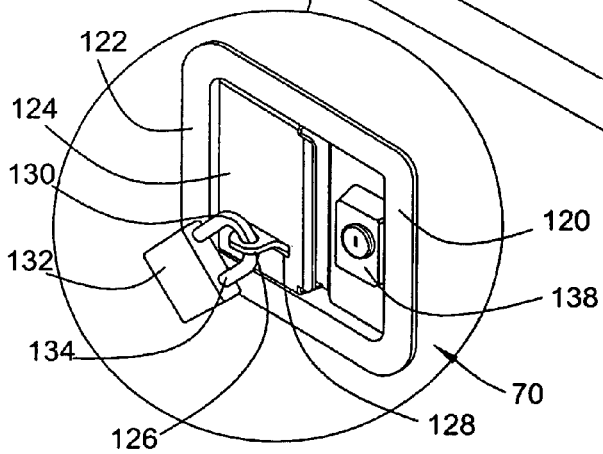
FIG. 2 is an enlarged detail view taken from FIG. 1 showing a padlock lockingly mounted to a paddle handle.
Figure 3:
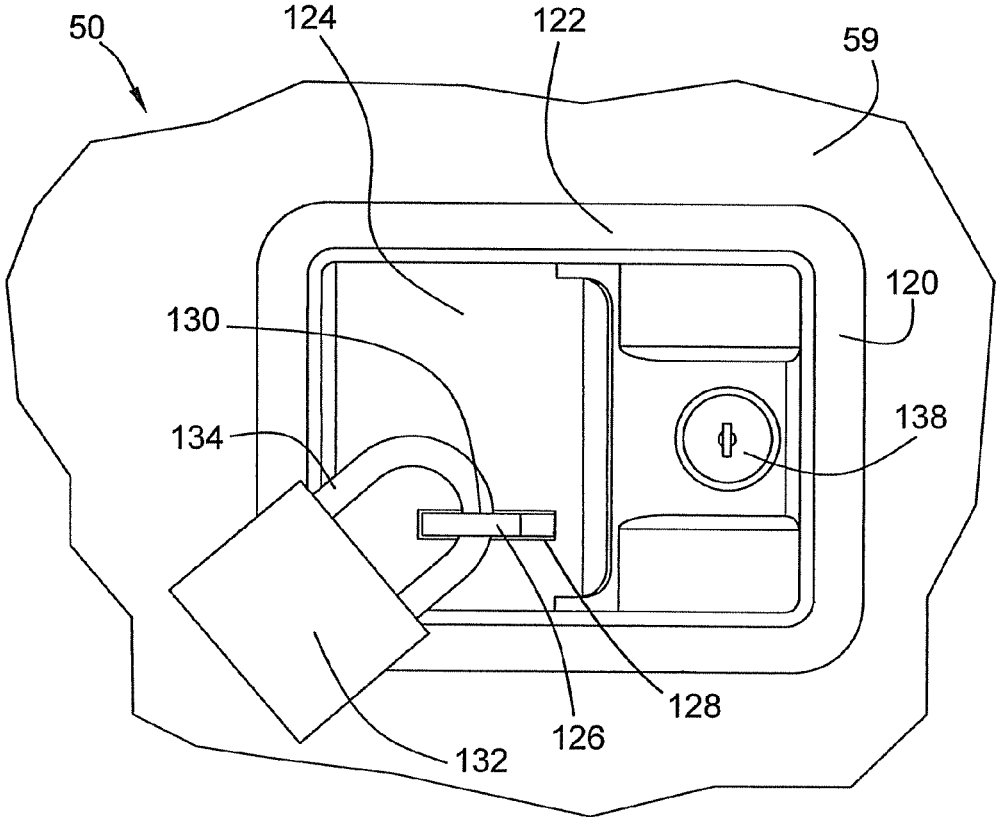
FIG. 3 is an enlarged, fragmentary front elevational view of the safety cabinet of FIG. 1 showing the padlock lockingly mounted to the paddle handle.

Referring to FIGS. 1-3, the latch system 70 can include a paddle handle 120. The latch system 70 controls the opening of the safety cabinet doors 58, 59 through operation of the paddle handle 70. The latch system can be configured to automatically latch the doors such that the paddle handle need not be actuated to latch the doors in the closed position. Referring to FIGS. 2 and 3, the paddle handle 120 includes a housing 122, an operating lever 124 to release the latch system 70, and a tang 126. The operating lever 124 includes a slot 128 configured to allow the tang 126 to extend therethrough when the operating lever 124 is in a normal position. The tang 126 can have a hole 130 therethrough to receive a padlock 132. The tang 126 can be configured such that when a locking arm 134 of the padlock 132 extends through the hole 130 of the tang 126 and is locked, the padlock 132 prevents the operating lever 124 from moving from the normal position. The padlock 132 can be any suitable padlock such as those commercially available from a multiplicity of sources, such as from Master Lock Co., LLC of Milwaukee, Wis., for example. The padlock 132 can be any commercially-available key-operated or combination lock, for example.

Referring to FIG. 2, the paddle handle 120 can include a second lock 138. The second lock 138 can be operable by a key, for example. When the key-operated lock 138 is locked, it can prevent the actuation of the paddle handle 120, which thereby prevents access to the interior of the safety cabinet 50. The padlock 132 and the key-operated lock 138 operate independently in that the state of one lock has no bearing on the state of the other lock. Accordingly, the safety cabinet 50 can include two locking means 132, 138 which both can be locked to selectively retain the operating lever 124 in the normal position, thereby locking the safety cabinet 50.

Referring to FIG. 5, the latch system 70 of the safety cabinet 50 can include the paddle handle 120, a first slide plate 140, a second slide plate 142, a bullet slam latch 144, a first latch rod assembly 146, and a second latch rod assembly 148. The latch system 70 may be substantially the same as the latch system of U.S. Pat. No. 6,729,701, except for those differences discussed above with respect to the paddle handle 120. When the doors 58, 59 are closed, the bullet latch 144 and the latch rod assemblies 146, 148 engage the left door 58 and the enclosure 52, respectively, to secure the doors 58, 59 closed. By actuating the paddle handle 120, the bullet latch 144 and the latch rod assemblies 146, 148 can be disengaged from the left door 58 and the enclosure 52, respectively. Actuating the paddle handle 120 allows a user to open the right door 59. The right door 59 can only be opened by actuation of the paddle handle 120. The left door 58 can be secured closed by the right door 59. When either the padlock or the second lock 138 is locked, thereby preventing actuation of the paddle handle 120, the doors 58, 59 cannot be opened and the safety cabinet 50 cannot be accessed. However, the latch system 70 is configured such that the doors 58, 59 are movable from the open position to the closed position without the actuation of the paddle handle 120 as described in U.S. Pat. No. 6,729,701.

Referring to FIG. 4, the closure system 68 can be operably arranged with the doors 58, 59 to bias the doors 58, 59 to the closed position. The retaining system 64 can selectively retain the doors 58, 59 in the open position. The closure system 68 and the retaining system 64 of the safety cabinet 50 may be substantially the same as the closure and retaining systems shown and described in U.S. Pat. Nos. 5,992,098 and 6,729,701. Accordingly, the retaining system 64 can retain the doors 58, 59 in an open position until the retaining system 64 is disengaged or overcome by the closure system 68. The retaining system 64 can include first and second fusible links 158, 159 which are mounted to the right and left doors 58, 59, respectively, and to the enclosure 52. The fusible links 158, 159 can be constructed such that the fusible links 158, 159 will fuse when the ambient temperature is above a selected level to thereby detach the links 158, 159 from the enclosure to allow the closure system 68 to move the doors 58, 59 to the closed position.

The closure system 68 provides an assist feature during the manual closing of the doors 58, 59 by urging the doors 58, 59 to the closed position once the retaining system 64 is overcome. Also, in the event of fire, for instance, the closure system 68 cooperates with the fusible links 158, 159 to automatically close the doors 58, 59. When the ambient temperature exceeds a predetermined level, the first fusible link 158 and the second fusible link 159 melt. First and second air cylinders 162, 163 of the closure system 68 can act to move the right and left doors 58, 59, respectively, to the closed position. The illustrative embodiment of the closure system 68 includes a timing mechanism 166 mounted to the enclosure 52 to control the sequence of the closing of the doors 58, 59 such that the left door 58 is placed in the closed position before the right door 59 is. The timing mechanism 166 can be constructed in a fashion similar to the timing mechanism shown and described in U.S. Pat. No. 5,992,098, which is incorporated herein by reference in its entirety.

Figure 8:
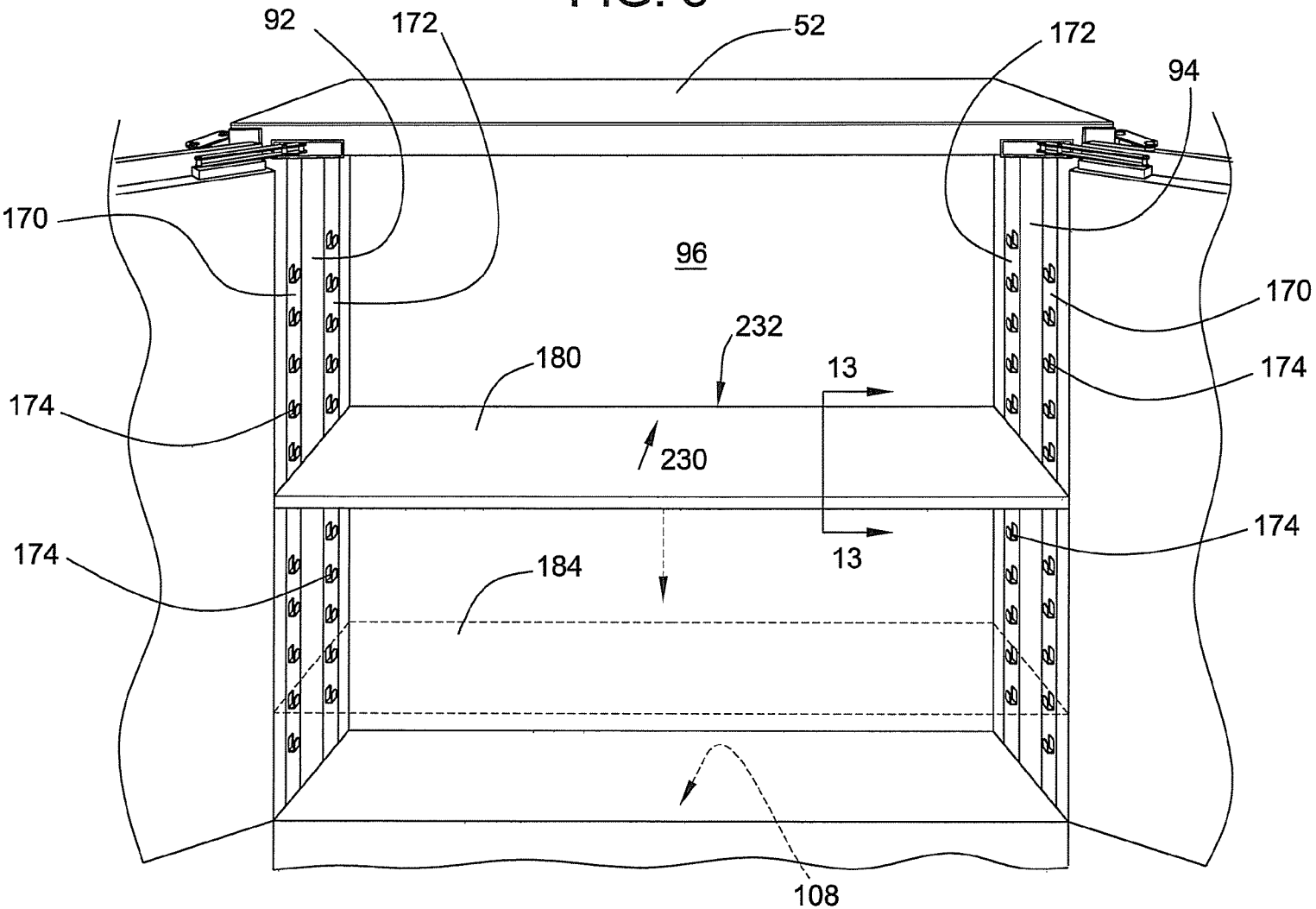
FIG. 8 is a fragmentary front perspective view of the safety cabinet of FIG. 1 with both of the doors in an open position.

Referring to FIG. 8, the inner left and right sidewalls 92, 94 each include a front shelf standard 170 and a rear shelf standard 172. The front shelf standards 170 of the inner left and right sidewalls 92, 94 are substantially identical to each other. The rear shelf standards 172 of the inner left and right sidewalls 92, 94 are substantially identical to each other, as well. The front and rear shelf standards 170, 172 of both the left and right sidewalls 92, 94 can be disposed a predetermined distance apart from each other such that a mounting distance 173 (FIG. 9) separates the front and rear shelf standards 170, 172.

As shown in FIG. 8, each front shelf standard 170, 172 has a plurality of shelf mounts 174. One of the shelf mounts 174 from each of the front and rear shelf standards 170, 172 supports a spill-sloped shelf 180. The shelf mounts 174 are arranged to allow the shelf 180 to be adjustably mounted to the shelf standards 170, 172 to allow for variable spacing between the shelf 180 and other spill-sloped shelves mounted in the enclosure and the base and/or the top of the enclosure 52. The shelf mounts 174 of each shelf standard 170, 172 are disposed in evenly-spaced relationship with respect to each other to allow for the incrementally-adjustable mounting of the shelf 180. Each shelf standard 170, 172 includes a corresponding plurality of shelf mounts disposed in spaced relationship to each other such that one or more shelves can be adjustably mounted to the four shelf standards.

Figure 9:
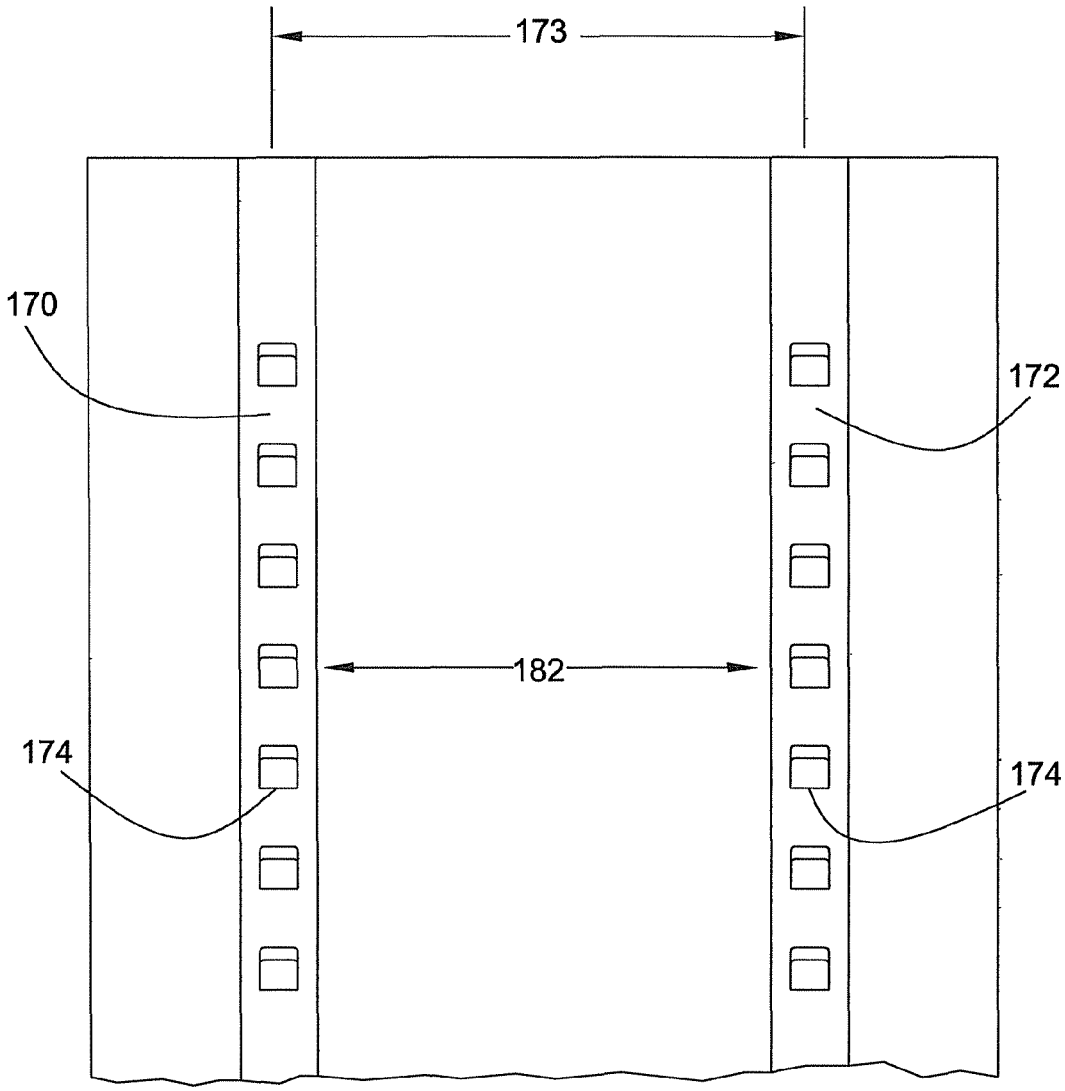
FIG. 9 is a fragmentary elevational view of an inner portion of a left sidewall of the safety cabinet of FIG. 1.

Referring to FIG. 9, each shelf mount 174 that is located on the front shelf standard 170 of the left sidewall 92 has a corresponding shelf mount 174 that is located on the rear shelf standard 172 of the left sidewall 92, and each pair of corresponding shelf mounts 174 are disposed along a mounting axis 182. Referring to FIG. 8, the front and rear shelf standards 170, 172 of the right sidewall 94 are substantially identical to the front and rear shelf standards 170, 172, respectively, of the left sidewall 92. The shelf mounts 174 of the front and rear shelf standards 170, 172 define a plurality of mounting planes 184 that are in vertical-spaced relationship with respect to each other.

In the illustrative embodiment, the shelf mounts 174 are each in the form of a hook. In other embodiments, the shelf mounts can be in the shape of a pin with a generally cylindrical body, a pin with a generally planar distal end, a cleat with a generally rectangular shape, or any other suitable support. In other embodiments, the shelf standards can include a series of holes in spaced relationship to each other that are configured to receive a support, such as, a pin, for example for supporting the shelf.

Figure 11:
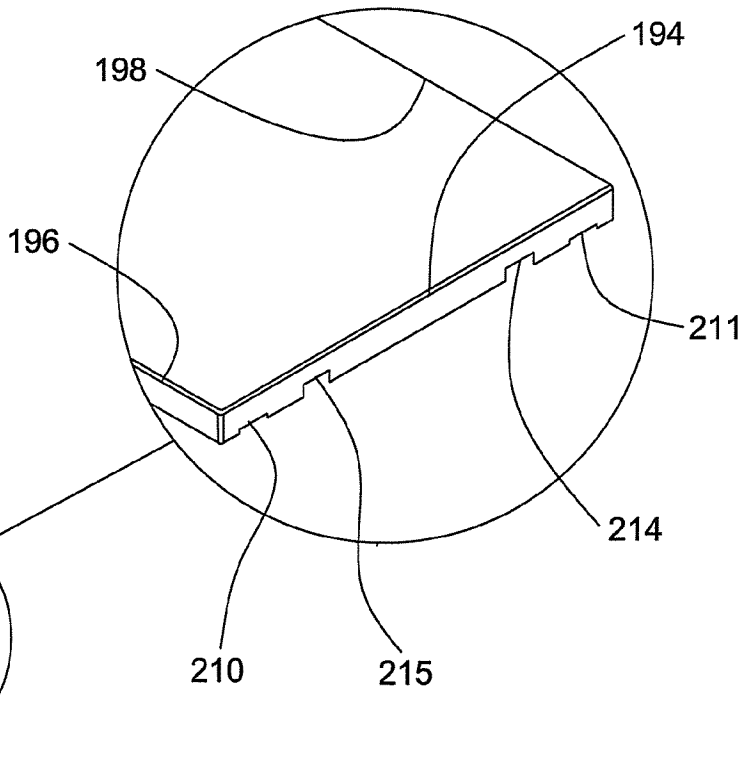
FIG. 11 is an enlarged detail view taken from FIG. 10 of a second end of the spill-sloped shelf.
Figure 10:
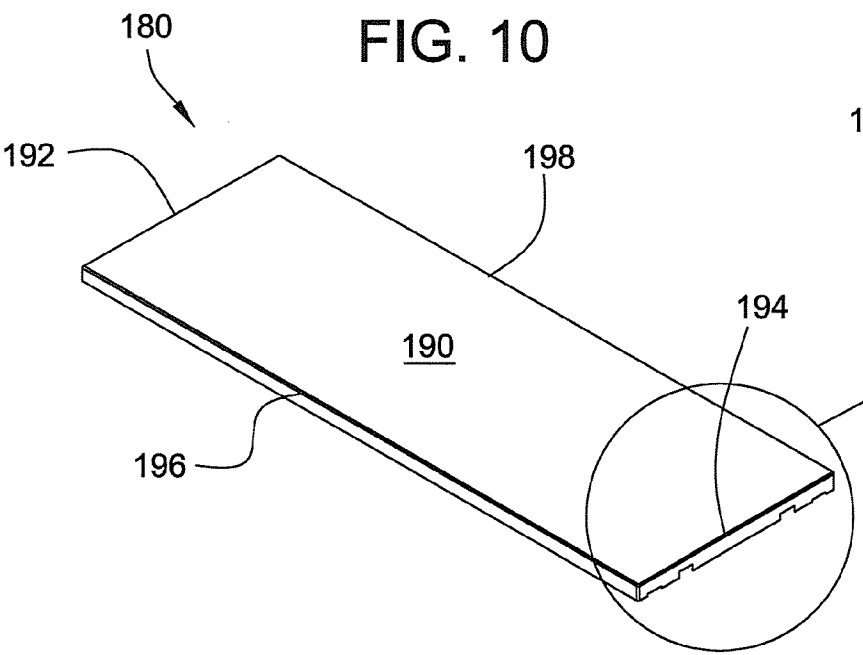
FIG. 10 is a perspective view of the spill-sloped shelf of the safety cabinet of FIG. 1.
Figure 12:
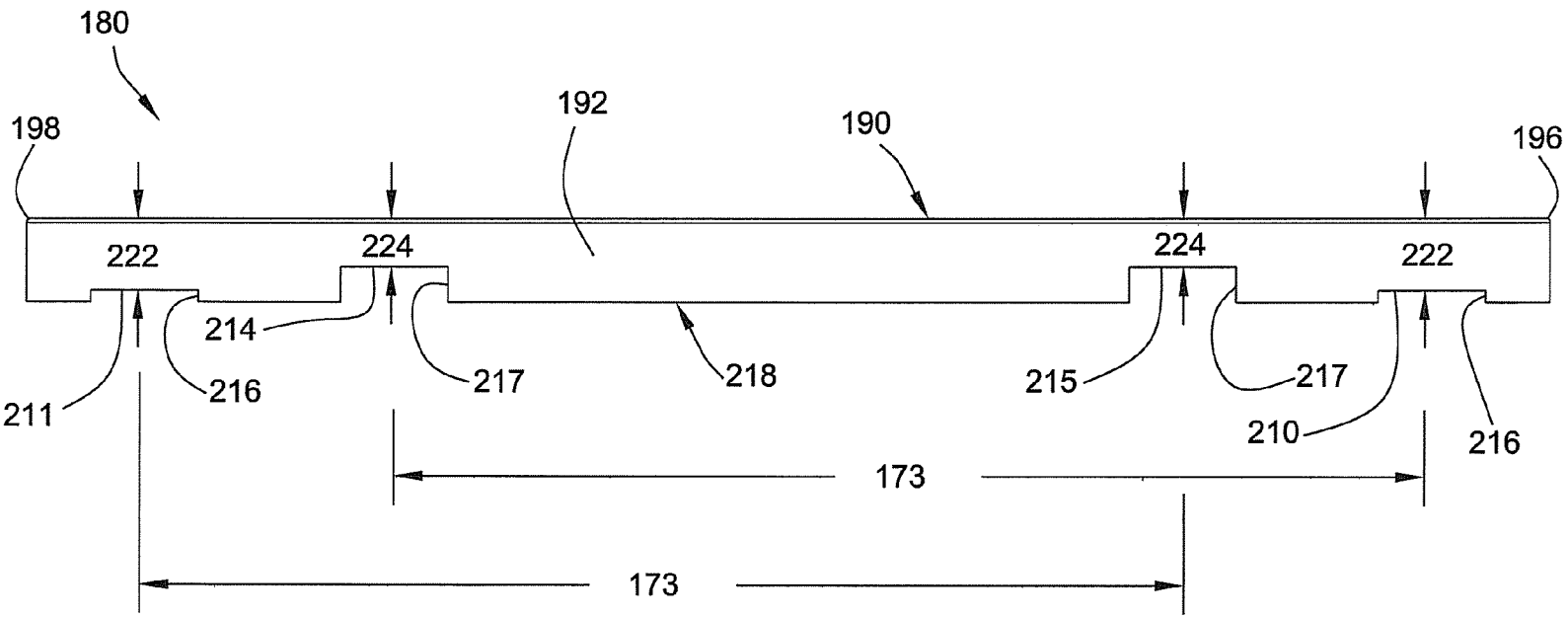
FIG. 12 is an end elevational view of the spill-sloped shelf of FIG. 10.

Referring to FIGS. 10-12, the spill-sloped shelf 180 can include a support surface 190, first and second ends 192, 194, and first and second edges 196, 198. The support surface includes a perimeter 200. The first and second ends 192, 194 and the first and second edges 196, 198 comprise a flange 202 that depends from the perimeter 200 of the support surface 190. The perimeter 200 of the support surface 190 is rectangular, and the flange 202, extending around the perimeter 200, has a corresponding shape.

The first and second ends 192, 194 are in spaced relationship to each other and longitudinally define the support surface 190. The support surface extends longitudinally between the first and second ends 192, 194. The first and second edges 196, 198 are in spaced relationship to each other and laterally define the support surface 190. The first and second edges 196, 198 extend between the first and second ends 192, 194.

The first and second ends 192, 194 are substantially identical to each other, each being a mirror image of the other. The spill-sloped shelf 180 can be mounted to the shelf standards of the enclosure such that the support surface 190 is inclined with respect to the mounting plane defined by the shelf mounts to which it is engaged with the front-most edge being higher than the rear-most edge.

Referring to FIG. 12, the first end 192 of the shelf 180 has a pair of first mounting surfaces 210, 211 and a pair of second mounting surfaces 214, 215. Each of the mounting surfaces 210, 211, 214, 215 is disposed in a notch 216, 217 extending from a bottom surface 218 of the first end 192 toward the support surface 190 of the shelf 180. The first mounting surfaces 210, 211 of the shelf are disposed in offset relationship with respect to the second mounting surfaces 214, 215.

The first mounting surfaces 210, 211 are disposed a first distance 222 away from the support surface 190. The second mounting surfaces 214, 215 are disposed a second distance 224 away from the support surface 190. The first distance 222 is greater than the second distance 224 by a predetermined amount. The first mounting surfaces 210, 211 are disposed in outer relationship with respect to the second mounting surfaces 214, 215.

One 210 of the first mounting surfaces is positioned relative to one 214 of the second mounting surfaces such that these mounting surfaces 210, 214 are separated from each other by the mounting distance 173 separating the front and rear shelf standards mounted to the enclosure and can be used to mount the first end 192 of the shelf 180 to the shelf standards of the inner left sidewall of the enclosure. The other 211 of the first mounting surfaces and the second mounting surfaces 215 are positioned relative to each other such that these mounting surfaces 211, 215 are separated from each other by the mounting distance 173 separating the front and rear shelf standards mounted to the enclosure and can be used to mount the first end of the shelf 180 to the shelf standards of the inner right sidewall of the enclosure.

The first mounting surface 210 adjacent the first edge 196 and the second mounting surface 214 adjacent the second edge 198 of the shelf 180 are disposed a predetermined amount from each other that is substantially the same as the mounting distance 173 separating the front and rear shelf standards of both the left and right sidewalls. The first mounting surface 211 adjacent the second edge 198 of the shelf and the second mounting surface 215 adjacent the first edge 196 of the shelf are disposed the same mounting distance 173 apart from each other. This construction, i.e., having two shallow notches 210, 211 and two deep notches 215, 216 at each end allows the spill-sloped shelf 180 to be mounted in the enclosure of the safety cabinet 50 with either the first or second end adjacent to either the left or right sidewall 92, 94 of the safety cabinet.

Referring to FIG. 11, the second end 194 of the shelf 180 is the mirror image of the first end 192 of the shelf. The first mounting surfaces 210, 211 of the second end 194 are in respective opposing relationship to the first mounting surfaces 210, 211 of the first end 192. The second pair of mounting surfaces 214, 215 of the second end 194 is in respective opposing relationship to the second mounting surfaces 214, 215 of the first end 192.

Figure 13:
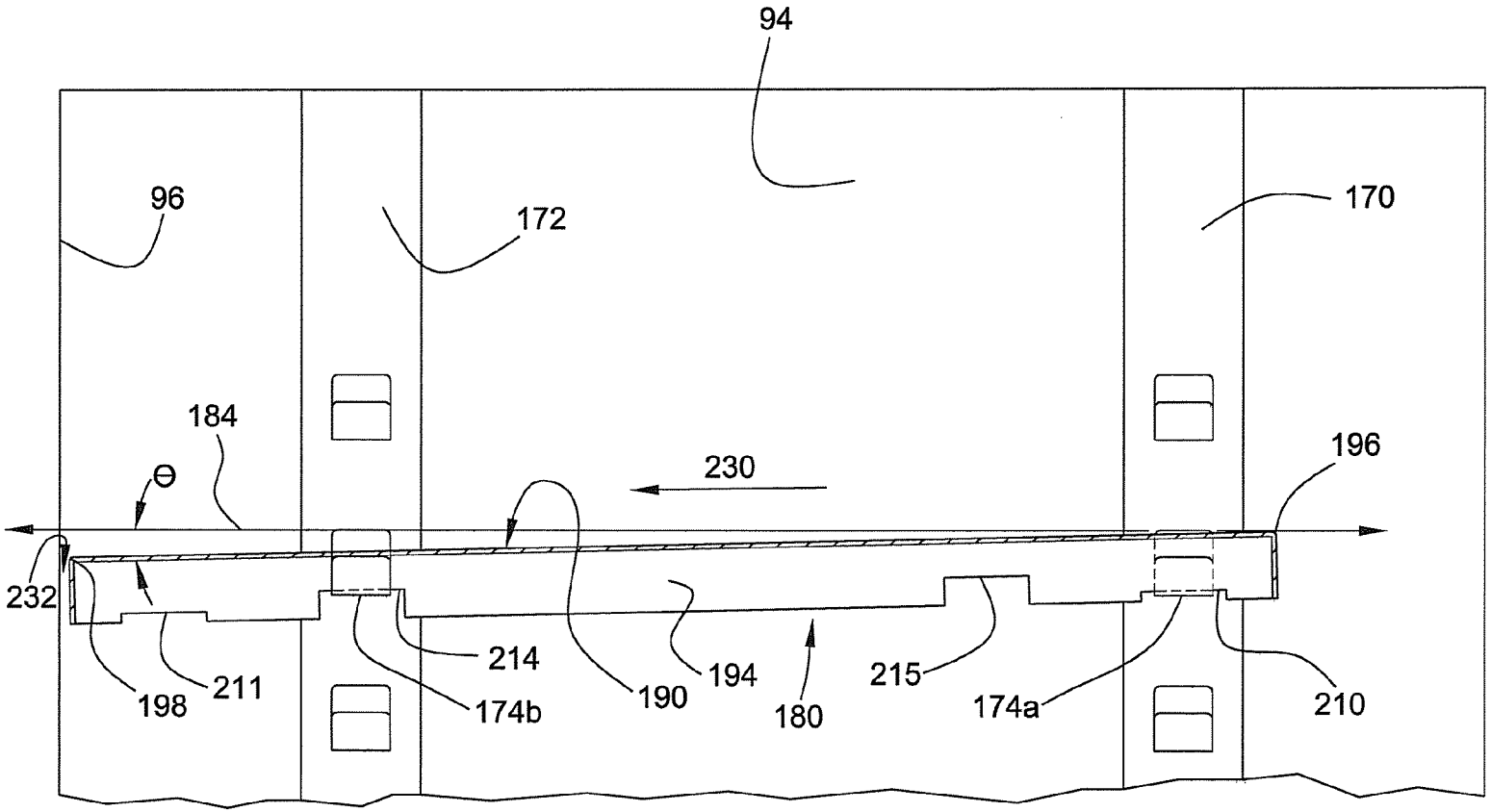
FIG. 13 is a partial, fragmentary cross-sectional view taken along line 13-13 in FIG. 8 of an inner right sidewall of the safety cabinet of FIG. 1 with the second end of the spill-sloped shelf mounted thereto.

Referring to FIGS. 8 and 13, the support surface 190 of the spill-sloped shelf 180 can be disposed at a spill-sloped angle θ (FIG. 13), relative to the mounting plane 184, such that, if liquid were present on the shelf 180, gravity would cause the liquid to flow in a rear-ward direction 230, toward the back wall 45 of the enclosure 52. A gap 232 can be defined between the back wall 96 and the rear-most edge 198 of the spill-sloped shelf 180 such that a liquid disposed on the support surface 190 of the shelf 180, and under the effect of gravity, will be urged toward the rear-most edge 198 of the shelf 180 to drip from the rear-most edge through the space 232 between the rear-most edge of the shelf and the back wall and to collect in the sump area of the base of the enclosure. The spill-sloped angle θ can be any suitable angle that allows an amount of liquid to flow in the rearward direction 230 while allowing containers to be supported upon the support surface without being subjected to unduly tipping forces. In certain embodiments, the spill-sloped angle θ can be between 2° and 15°, for example.

The liquid can be stored in the sump area 108 to allow for the efficient removal of the liquid from the enclosure 52. The sump area 108 can include a drain for removing the liquid therefrom.

Figure 14:
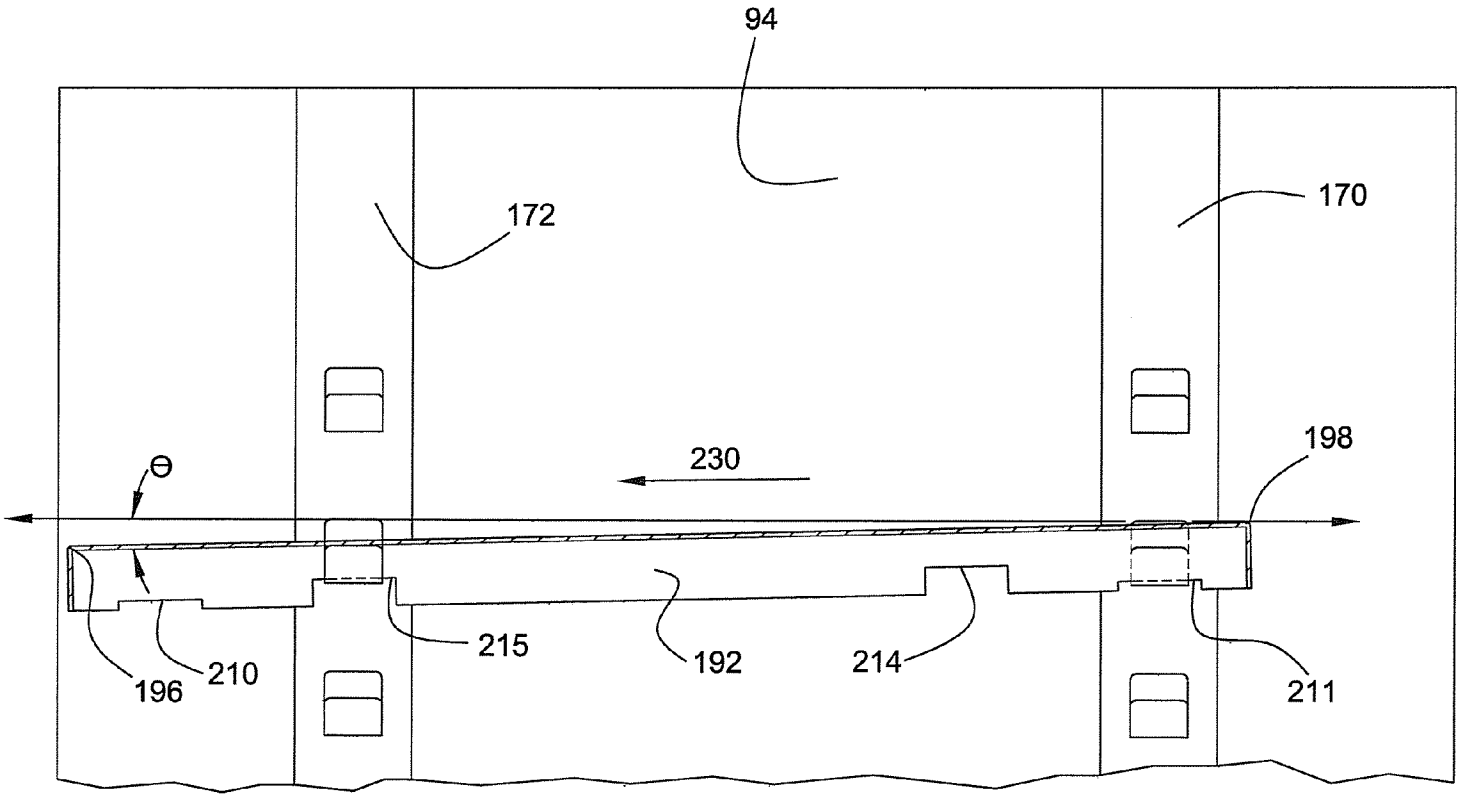
FIG. 14 is a view as in FIG. 13 but with the first end of the spill-sloped shelf mounted to the inner right sidewall of the safety cabinet of FIG. 1.

As illustrated in FIGS. 13 and 14, either end 192, 194 of the spill-sloped shelf 180 can connect to inner right sidewall 94 of the safety cabinet 50. Likewise, either end of the spill-sloped shelf 180 can connect to inner left sidewall of the safety cabinet. Referring to FIG. 13, the second end 194 of the spill-sloped shelf 180 connects to the inner right sidewall 94 of the safety cabinet 50. The first mounting surface 210 adjacent the first edge 196 and the second mounting surface 214 adjacent the second edge 198 of the second end 194 are mounted to corresponding shelf mounts 174*a*, 174*b* of the front and rear shelf standards 170, 172, respectively. The first mounting surface 211 adjacent the second edge 198 of the shelf and the second mounting surface 215 adjacent the first edge 196 of the second end 194 are disengaged.

Referring to FIG. 14, the first end 192 of the spill-sloped shelf 180 is mounted to the inner right sidewall 94 of the safety cabinet 50. The first mounting surface 211 adjacent the second edge 198 and the second mounting surface 215 adjacent the first edge 196 of the first end 192 are mounted to corresponding shelf mounts 174*a*, 174*b* of the front and rear shelf standards 170, 172, respectively. The first mounting surface 210 adjacent the first edge 196 of the shelf and the second mounting surface 214 adjacent the second edge 198 of the first end 192 are disengaged.

FIGS. 13 and 14 illustrate that, regardless of which end 192, 194 of the spill-sloped shelf 180 is mounted to which inner sidewall of the enclosure, the rear-most edge of the shelf will be disposed at a lower vertical height than the front-most edge of the shelf. Furthermore, the support surface 190 will be disposed at the spill-sloped angle θ relative to the mounting plane defined by the shelf supports, which urges liquid to flow in the rearward direction 230 off the spill-sloped shelf 180 and into the gap 232. In other words, the spill-sloped angle θ is created when either the first edge or the second edge of the shelf is the rear-most edge.

Accordingly, a user, when installing the spill-sloped shelf 180, need not consider the orientation of the shelf 180. This enables the user to quickly and efficiently install the spill-sloped shelf 180. Additionally, this arrangement ensures that the spill-sloped shelf 180 is installed such that it slopes downward at a spill-sloped angle θ to thereby encourage any liquid spilled on the shelf to flow in the rearward direction through the gap between the rear-most edge of the shelf and the back wall and into the sump area.

Figure 15:
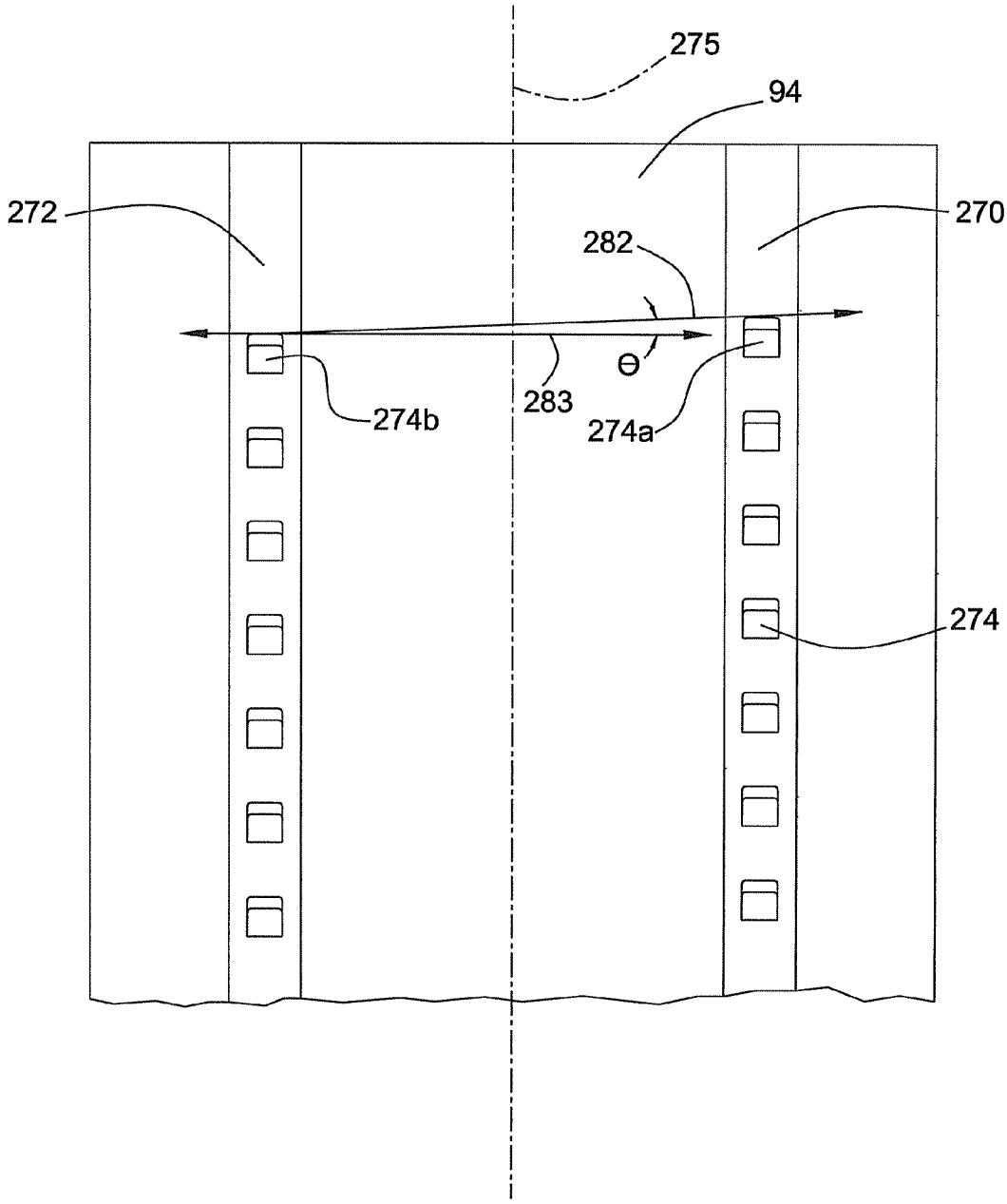
FIG. 15 is a fragmentary elevational view of another embodiment of a pair of shelf standards suitable for use with the present invention.
Figure 16:
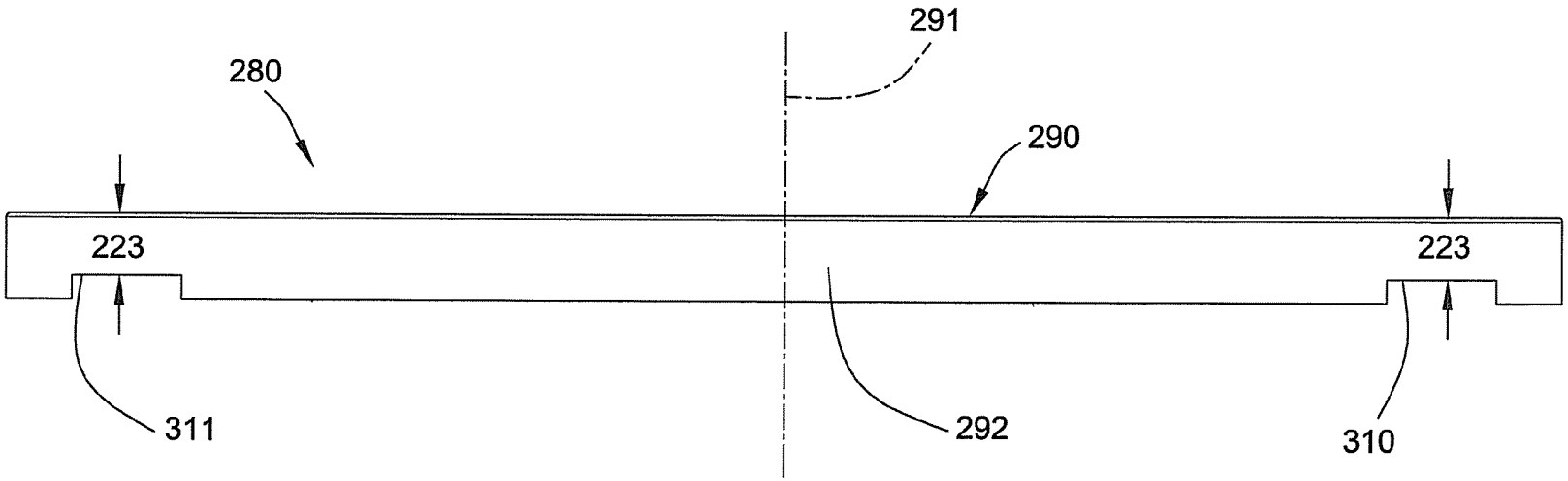
FIG. 16 is an end elevational view of another embodiment a shelf suitable for use with the shelf standards of FIG. 15.

Referring to FIGS. 15 and 16, another embodiment front and rear shelf standards 270, 272 (FIG. 15) and a shelf 280 (FIG. 16) are shown. Referring to FIG. 15, the front and rear shelf standards 270, 272 are mounted to the inner right sidewall 94. The front shelf standard 270 includes a plurality of shelf mounts 274 disposed in evenly spaced relationship with respect to each other. The rear shelf standard 272 includes a corresponding plurality of shelf mounts 274 disposed in the same evenly spaced relationship to each other. However, each shelf mount 274*a* of the front standard 270 is disposed in offset relationship to the corresponding shelf mount 274*b* of the rear standard 272 such that the mounting axis 282 defined therebetween is substantially non-horizontal when the enclosure is leveled with respect to the horizon. In particular, the mounting axis 282 defines a spill-sloped angle θ with respect to a horizontal axis 283. The front and rear shelf standards 270, 272 can be disposed an equal distance from an axisymmetrical centerline 275 of the inner right sidewall 94. The inner left sidewall can include a pair of front and rear shelf standards that are the same as the standards 270, 272 mounted to the inner right sidewall 94.

Referring to FIG. 16, the shelf 280 can have at its first end 292 a pair of mounting surfaces 310, 311 disposed the same distance 223 away from the support surface 290. The mounting surfaces can be disposed an equal distance from an axisymmetrical centerline 291 of the shelf 280 and can be separated the same distance apart from each other as the front and rear shelf standards 270, 272 of FIG. 15 are separated from each other. The second end of the shelf 280 can be the same as the first end. Accordingly, either the first or the second end of the shelf 280 can be mounted to either of the left and right sidewalls of the enclosure.

Referring to FIG. 17, another embodiment of a safety cabinet 350 suitable for use with the present invention is shown. The safety cabinet 350 includes a single door 359 rotatably mounted to the enclosure 352 of the safety cabinet. The door 359 can be moved between a closed position wherein the opening of the enclosure is occluded and an open position wherein a user can access the interior cavity defined by the enclosure 352. The bullet slam latch of the latch mechanism 370 can selectively engage the left jamb 411. The safety cabinet 350 can be similar in other respects to the safety cabinet 50 of FIG. 1.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A safety cabinet comprising;

an enclosure defining an interior cavity, the enclosure having a base and a top, the base having a sump area therein, the enclosure having a face defining an opening, the opening in communication with the cavity, first and second sidewalls, and a back wall, the face, first and second sidewalls and back wall extending between the base and the top;

a door rotatably attached to the enclosure, the door movable between an open position and a closed position, the door configured to selectively cover the at least a portion of the enclosure when in the closed position;

a first pair of shelf mounts mounted to the interior cavity of the enclosure, the shelf mounts being in spaced relationship to each other;

a second pair of shelf mounts mounted to the interior cavity of the enclosure, the shelf mounts being in spaced relationship to each other; and a shelf disposed in the cavity of the enclosure, the shelf supported by the first and second pair of shelf mounts, the shelf having a support surface, first and second ends, and first and second edges, the support surface extending longitudinally between the first and second ends, the first and second edges being in spaced relationship to each other and laterally defining the support surface, the first and second edges extending longitudinally between the first and second ends;

wherein the first end has a first mounting surface and a second mounting surface, the first mounting surface closer to the first edge than to the second edge, the second mounting surface closer to the second edge than the first edge, the first mounting surface being a first distance away from the support surface along a direction perpendicular to the support surface and the first mounting surface, the second mounting surface being a second distance away from the support surface along a direction perpendicular to the support surface and the second mounting surface, the first distance being greater than the second distance;

wherein the second end has a first mounting surface and a second mounting surface, the first mounting surface closer to the first edge than to the second edge, the second mounting surface closer to the second edge than the first edge, the first mounting surface being a first distance away from the support surface along a direction perpendicular to the support surface and the first mounting surface, the second mounting surface being a second distance away from the support surface along a direction perpendicular to the support surface and the second mounting surface, the first distance being greater than the second distance; and wherein the shelf is supported by the first and second pairs of shelf mounts such that the second edge is adjacent the back wall of the enclosure, the shelf mounts respectively supporting the mounting surfaces of the first and second ends of the shelf such that the support surface of the shelf is inclined with the first edge being vertically higher than the second edge.

2. The safety cabinet of claim 1, wherein the first sidewall includes a pair of shelf standards, and the second sidewall includes a pair of shelf standards, each shelf standard including a plurality of shelf mounts disposed in spaced relationship to each other such that the shelf can be adjustably mounted to the four shelf standards with the support surface being inclined with the first edge being higher than the second edge.

3. The safety cabinet of claim 1, wherein the shelf mount is a device selected from the group consisting of a hook, a cleat, and a pin.

4. The safety cabinet of claim 1, wherein the shelf includes:

a third mounting surface and a fourth mounting surface associated with the first end, the third mounting surface closer to the first edge than to the second edge, the fourth mounting surface closer to the second edge than the first edge, the third mounting surface being a third distance away from the support surface, the second mounting surface being a fourth distance away from the support surface, the third distance being less than the fourth distance;

a third mounting surface and a fourth mounting surface associated with the second end, the third mounting surface closer to the first edge than to the second edge, the fourth mounting surface closer to the second edge than the first edge, the third mounting surface being a third distance away from the support surface, the second mounting surface being a fourth distance away from the support surface, the third distance being less than the fourth distance;

wherein the third and fourth mounting surfaces of the first and second ends of the shelf are supportable by the first and second pairs of shelf mounts such that the first edge is adjacent the back wall of the enclosure and the support surface of the shelf is inclined with the second edge being higher than the first edge.

5. The safety cabinet of claim 1, wherein the second edge of the shelf and the back wall define a space therebetween such that a liquid disposed on the support surface of the shelf, and under the effect of gravity, will be urged toward the second edge of the shelf to drip from the second edge through the space between the second edge and the back wall and to collect in the sump area.

6. The safety cabinet of claim 1, further comprising a second door rotatably attached to the enclosure, the second door being rotatable between an open position and a closed position, the doors, when in the closed position, cooperating with each other to cover the opening of the enclosure.

7. The safety cabinet of claim 1, further comprising a latch system arranged with the door to selectively retain the door in the closed position.

8. The safety cabinet of claim 7, further comprising:

a paddle handle adapted to selectively actuate to allow the door to move from the closed position to the open position; and a lock, the lock preventing the actuation of the paddle handle when locked.

9. The safety cabinet of claim 7, wherein the latch system includes a paddle handle operable to selectively release the latch system, the paddle handle disposed on the door.

10. The safety cabinet of claim 9, further comprising: a padlock that is selectively lockable to the paddle handle to prevent the operation of the paddle handle.

11. The safety cabinet of claim 1, further comprising: a closure system operably arranged with the door to bias the door to the closed position.

12. The safety cabinet of claim 11, further comprising: a retaining system to selectively retain the door in the open position, the retaining system having a fusible link, the fusible link being constructed such that the fusible link will fuse when the ambient temperature is above a predetermined level to thereby allow the closure system to move the door to the closed position.

13. The safety cabinet of claim 1, wherein the enclosure includes a plurality of leveling legs to selectively adjust the orientation of the enclosure with respect to a surface upon which the safety cabinet is placed.

* * * * *